US008215269B2

(12) United States Patent
Yasuda

(10) Patent No.: US 8,215,269 B2
(45) Date of Patent: Jul. 10, 2012

(54) TWO-STROKE ENGINE

(75) Inventor: Terutaka Yasuda, Chiyoda-ku (JP)

(73) Assignee: Maruyama Mfg. Co., Inc., Tokyo (JP)

( * ) Notice: Subject to any disclaimer, the term of this patent is extended or adjusted under 35 U.S.C. 154(b) by 302 days.

(21) Appl. No.: 12/629,240

(22) Filed: Dec. 2, 2009

(65) Prior Publication Data

US 2010/0139637 A1 Jun. 10, 2010

(30) Foreign Application Priority Data

Dec. 5, 2008 (JP) ..... P2008-311104

(51) Int. Cl.
*F02B 75/24* (2006.01)

(52) U.S. Cl. ..... 123/53.1; 123/51 BB

(58) Field of Classification Search ..... 123/51 BB, 123/53.1
See application file for complete search history.

(56) References Cited

U.S. PATENT DOCUMENTS

| | | | | |
|---|---|---|---|---|
| 1,956,804 | A * | 5/1934 | Meyer | 123/197.4 |
| 5,076,220 | A * | 12/1991 | Evans et al. | 123/65 VC |
| 5,146,884 | A * | 9/1992 | Merkel | 123/197.4 |
| 5,186,127 | A * | 2/1993 | Cuatico | 123/53.1 |
| 5,394,839 | A * | 3/1995 | Haneda | 123/53.1 |
| 5,816,201 | A * | 10/1998 | Garvin | 123/53.1 |
| 6,058,901 | A * | 5/2000 | Lee | 123/197.1 |
| 6,173,683 | B1 * | 1/2001 | Nemoto et al. | 123/73 PP |
| 6,647,935 | B2 * | 11/2003 | Aoyama et al. | 123/90.16 |
| 6,748,909 | B2 * | 6/2004 | Drecq | 123/66 |
| 6,851,401 | B2 * | 2/2005 | Nystrom | 123/53.1 |

FOREIGN PATENT DOCUMENTS

| | | | |
|---|---|---|---|
| EP | 0 569 630 | | 11/1993 |
| GB | 2219345 | A * | 12/1989 |
| JP | 52-155828 | | 11/1977 |
| JP | 54-89115 | | 7/1979 |
| JP | 56-37066 | | 8/1981 |
| JP | 63-045425 | A | 2/1988 |
| JP | 2-149731 | | 6/1990 |
| JP | H02-23795 | Y2 | 6/1990 |
| JP | 2001-140651 | | 5/2001 |

OTHER PUBLICATIONS

English Patent Abstract of JP 63-045425 from esp@cenet, Published Feb. 26, 1988 (1 Page).
Notice of Allowance from JP Application No. 2008-311104, Dated Mar. 29, 2011 (3 Pages with Machine Translation).
Japanese Office Action for Japanese Application No. 2008-311104, mailed on Nov. 16, 2010 (2 pages).

(Continued)

*Primary Examiner* — Noah Kamen
*Assistant Examiner* — Hung Q Nguyen
(74) *Attorney, Agent, or Firm* — Osha • Liang LLP

(57) ABSTRACT

A two-stroke engine has a scavenging port for introduction of a working gas containing fuel, into a combustion chamber, and an exhaust port for discharge of gas in the combustion chamber therefrom, in which a piston connected to a crankshaft through a connecting rod reciprocates in the combustion chamber with rotary drive of the crankshaft, to control opening and closing of the scavenging port and the exhaust port, in which as the piston moves from a top dead center to a bottom dead center, the exhaust port and the scavenging port open in the order named, and in which as the piston moves from the bottom dead center to the top dead center, the scavenging port and the exhaust port close in the order named.

2 Claims, 3 Drawing Sheets

OTHER PUBLICATIONS

Patent Abstracts of Japan for Japanese Publication No. 02-149731, Publication date Jun. 8, 1990 (1 page).
esp@cenet patent abstract for Japanese Publication No. 2001140651, Publication date May 22, 2001 (1 page).
Swedish Office Action for Swedish Application No. 0950926-6, mailed on Jul. 7, 2010 (7 pages).
Patent Abstracts of Japan for Japanese Publication No. 54089115, Publication date Jul. 14, 1979 (1 page).

* cited by examiner

TWO-STROKE ENGINE

TECHNICAL FIELD

The present invention relates to a two-stroke engine.

BACKGROUND ART

There is a conventionally known two-stroke engine having a scavenging port for introduction of a working gas containing fuel into a combustion chamber, and an exhaust port for discharge of gas in the combustion chamber therefrom, wherein a piston connected to a crankshaft through a connecting rod reciprocates in the combustion chamber with rotary drive of the crankshaft, to control opening and closing of the scavenging port and the exhaust port, wherein as the piston moves from a top dead center (TDC) to a bottom dead center (BDC), the exhaust port and the scavenging port open in the order named, and wherein as the piston moves from BDC to TDC, the scavenging port and the exhaust port close in the order named.

Incidentally, in the foregoing conventional two-stroke engine there is almost no pressure difference between the combustion chamber and the exhaust port during a period of time after an end of a scavenging stroke in which the piston moves from TDC to BDC, and before a start of a compression stroke in which the scavenging port closes and the exhaust port also closes soon thereafter with an ascent of the piston, and it causes fresh gas (air-fuel mixture) in the combustion chamber to easily flow out through the exhaust port. The outflow results in so-called "blow-by," i.e., the whole fresh gas introduced through the scavenging port into the combustion chamber flows out directly through the exhaust port without staying inside the combustion chamber. This blow-by fresh gas was released as unburnt gas into the atmosphere without being purged. Since the unburnt gas consists primarily of fuel, it thus contains a large amount of hydrocarbons and increases a total hydrocarbon (THC) amount in exhaust gas.

For avoiding it, for example, the two-stroke engine described in Patent Document 1 below is constructed in a configuration wherein before introduction of fresh gas in the scavenging stroke, exhaust gas for blow-by is first introduced through a first scavenging port into the combustion chamber and the fresh gas is then introduced through a second scavenging port to scavenge the combustion chamber, thereby preventing the blow-by of fresh gas and reducing the THC amount in the exhaust gas.

PRIOR ART DOCUMENT

Patent Document

Patent Document 1: Japanese Patent Application Laid-open No. 2001-140651

SUMMARY OF THE INVENTION

Problem to be Solved by the Invention

The two-stroke engine described in Patent Document 1 above, however, had a problem that the efficiency of gas exchange was low, because the exhaust gas was introduced before introduction of fresh gas in the scavenging stroke.

The present invention has been accomplished in order to solve the above problem and an object of the present invention is therefore to provide a two-stroke engine achieving effective reduction of blow-by while implementing efficient gas exchange.

Means for Solving the Problem

A two-stroke engine according to the present invention is a two-stroke engine comprising a scavenging port for introduction of a working gas containing fuel, into a combustion chamber, and an exhaust port for discharge of gas in the combustion chamber therefrom, in which a piston connected to a crankshaft through a connecting rod reciprocates in the combustion chamber with rotary drive of the crankshaft, to control opening and closing of the scavenging port and the exhaust port, in which as the piston moves from a top dead center to a bottom dead center, the exhaust port and the scavenging port open in the order named, and in which as the piston moves from the bottom dead center to the top dead center, the scavenging port and the exhaust port close in the order named, wherein a connection position between the piston and the connecting rod is offset to the same side as a position of a connection center of the connecting rod to the crankshaft with the exhaust port becoming closed by the piston moving from the bottom dead center (BDC) to the top dead center (TDC), with respect to a straight line passing a rotation center of the crankshaft and being parallel to reciprocating directions of the piston.

In this two-stroke engine, the connection position between the piston and the connecting rod is offset to the same side as the position of the connection center of the connecting rod to the crankshaft with the exhaust port becoming closed by the piston moving from BDC to TDC, with respect to the straight line passing the rotation center of the crankshaft and being parallel to the reciprocating directions of the piston, whereby a crank angle, which is an angle between a line segment connecting the connection center of the connecting rod to the crankshaft and the rotation center of the crankshaft with the exhaust port becoming closed by the piston moving toward TDC, and a line segment connecting a connection center of the connecting rod to the crankshaft with the piston at BDC and the rotation center of the crankshaft, becomes smaller than a crank angle, which is an angle between a line segment connecting the connection center of the connecting rod to the crankshaft and the rotation center of the crankshaft with the exhaust port becoming opened by the piston moving toward BDC, and the line segment connecting the connection center of the connecting rod to the crankshaft with the piston at BDC and the rotation center of the crankshaft. For this reason, a period of time before closing of the exhaust port during an ascent of the piston from BDC is made shorter than a period of time in which the exhaust port opens during a descent of the piston. This makes a period of time from opening of the exhaust port to arrival of the piston at BDC, long enough to achieve sufficient introduction of fresh gas and discharge of exhaust gas, so as to implement efficient gas exchange and it also decreases the period of time after completion of a scavenging stroke and before closing of the exhaust port, which used to be the cause of blow-by, so as to achieve effective reduction of the blow-by.

Preferably, the connection position between the piston and the connecting rod lies on a center axis of the piston, and the exhaust port is disposed on the opposite side to the side where the connection position is offset, with respect to the straight line. When this configuration is adopted, the piston itself is offset to the opposite side to the exhaust port with respect to the rotation center of the crankshaft and therefore a cylinder block housing the piston is arranged as shifted to the opposite side to the exhaust port with respect to a crankcase housing the crankshaft, which permits the length of cooling fins disposed on the exhaust port side of the cylinder block to be increased without change in the overall width of the two-stroke engine, thereby enhancing the cooling efficiency.

Effect of the Invention

As described above, the present invention enables effective reduction of the blow-by while implementing efficient gas exchange.

MODE FOR CARRYING OUT THE INVENTION

Figure 1:
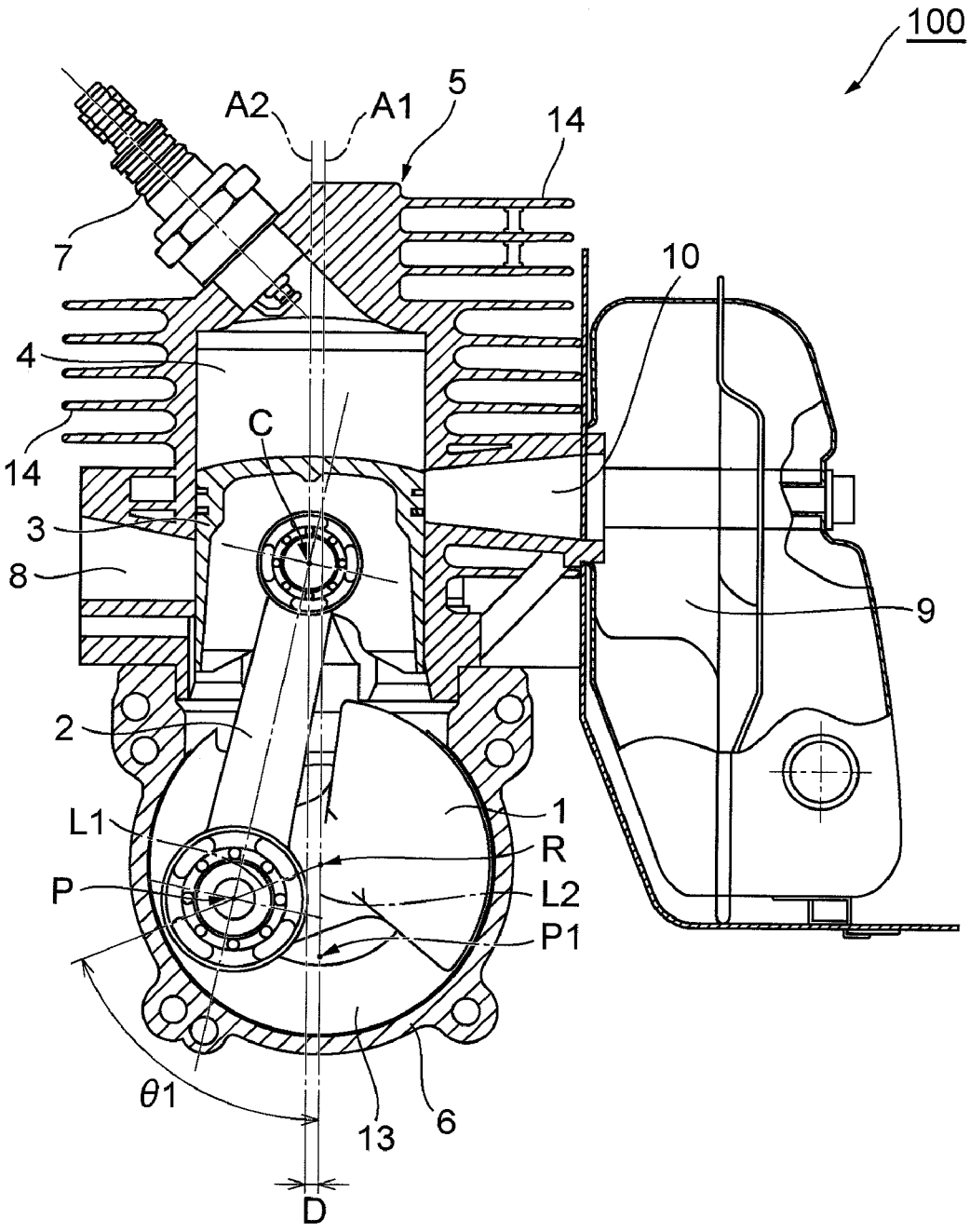
FIG. 1 is a vertical cross-sectional view showing a state in which a piston is moving toward TDC in a two-stroke engine according to an embodiment of the present invention.
Figure 2:
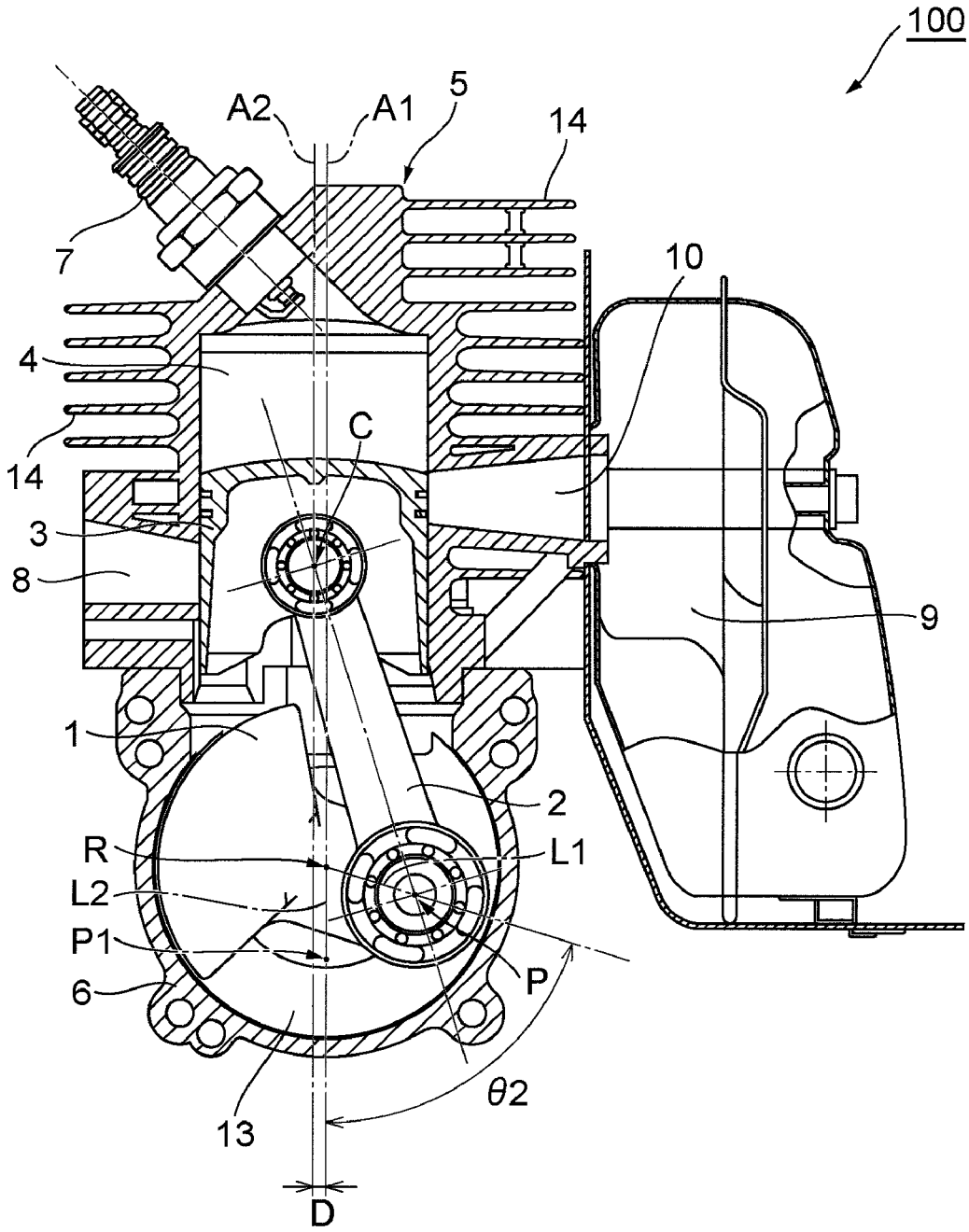
FIG. 2 is a vertical cross-sectional view showing a state in which the piston is moving toward BDC in the two-stroke engine.
Figure 3:
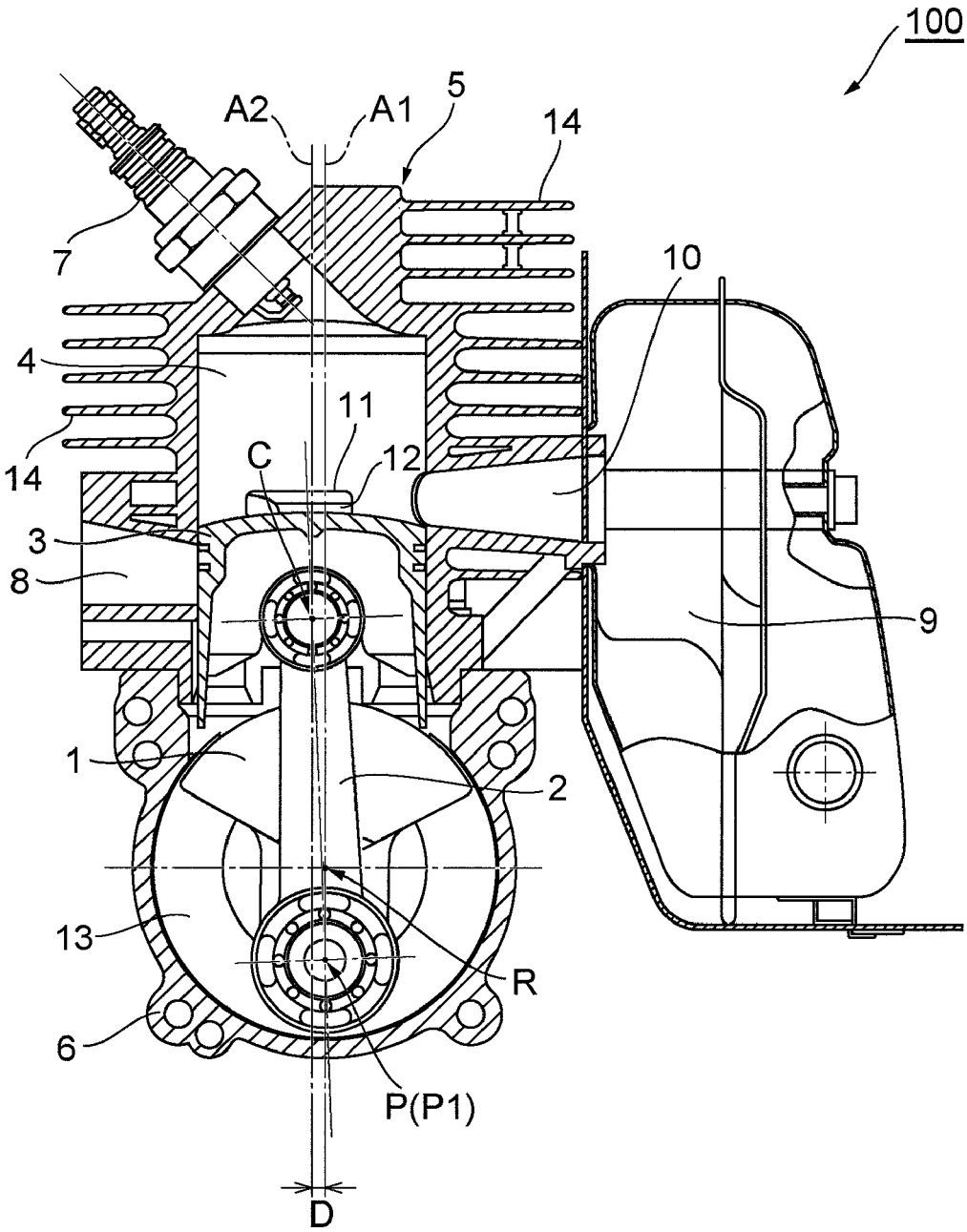
FIG. 3 is a vertical cross-sectional view showing a state in which the piston arrives at BDC in the two-stroke engine.

A preferred embodiment of the two-stroke engine according to the present invention will be described below with reference to the accompanying drawings. FIGS. 1 to 3 are vertical cross-sectional views showing the two-stroke engine according to an embodiment of the present invention: FIG. 1 shows a state in which a piston is moving toward the top dead center (TDC); FIG. 2 shows a state in which the piston is moving toward the bottom dead center (BDC); FIG. 3 shows a state in which the piston arrives at BDC.

As shown in FIGS. 1 to 3, the two-stroke engine 100 is one in which a piston 3 connected to a crankshaft 1 through a connecting rod 2 reciprocates in a combustion chamber 4 with rotary drive of the crankshaft 1. This two-stroke engine 100 has a shape as composed of a cylinder block 5 shown in the upper part and a crankcase 6 shown in the lower part, which is coupled to the cylinder block 5.

In the cylinder block 5 there is the combustion chamber (cylinder) 4 formed so as to allow the piston 3 to reciprocate therein as described above and discharge electrodes of a spark plug 7 are disposed in a recess at the top of the combustion chamber 4. This cylinder block 5 is provided with an inlet port 8 for introduction of an air-fuel mixture (working gas) into a crank chamber 13, which will be described below, and an exhaust port 10 for discharge of gas in the combustion chamber 4 therefrom to a muffler 9 so that the inlet port 8 and the exhaust port 10 can be in communication with the combustion chamber 4. These inlet port 8 and exhaust port 10 are arranged at respective positions 180° apart from each other in the circumferential direction of the combustion chamber 4 in the cylinder block 5 so that the exhaust port 10 is closer to TDC than the inlet port 8.

Inside the cylinder block 5, as shown in FIG. 3, there is a scavenging port 11 for introduction of an air-fuel mixture containing fuel into the combustion chamber 4. This scavenging port 11 is formed at a distal end of a scavenging passage 12 extending along the axial direction of the combustion chamber 4 and located at such a position that the scavenging port 11 opens to the interior of the combustion chamber 4 when the piston 3 is located near BDC.

This cylinder block 5 is provided with a plurality of cooling fins 14 for radiation which are juxtaposed in the vertical direction so as to project out, at positions on the exhaust port 10 side and at positions on the inlet port 8 side on the exterior surface.

On the other hand, the crankcase 6 has the crank chamber 13 formed in communication with the aforementioned scavenging passage 12; in this crank chamber 13 there are the crankshaft 1 forming a driving part of the piston 3, and the connecting rod 2 rotatably connected to the crankshaft 1; the piston 3 reciprocates in the vertical directions in the drawings in the combustion chamber 4 through the connecting rod 2 with rotation of the crankshaft 1, to control opening and closing of the scavenging port 11 and the exhaust port 10.

Specifically, as the crankshaft 1 rotates around a rotation center R, a connection center P of the connecting rod 2 to the crankshaft 1 circularly moves around the rotation center R of the crankshaft 1. As the piston 3 moves toward TDC, as shown in FIG. 1, the scavenging port 11 and the exhaust port 10 in the cylinder block 5 each come to close in the order named, to compress the air-fuel mixture in the combustion chamber 4. With further movement of the piston 3 toward TDC, the inlet port 8 comes into communication with the crank chamber 13, to allow the air-fuel mixture to flow into the crank chamber 13. When the piston 3 arrives at the vicinity of TDC of the combustion chamber 4, the spark plug 7 undergoes electric discharge to cause ignition and explosion of fuel in the air-fuel mixture inside the combustion chamber 4. The explosive force moves the piston 3 toward BDC. The above process is called a compression stroke.

After the ignition of the air-fuel mixture, as shown in FIG. 2, the piston 3 moves toward BDC to increase the capacity of the combustion chamber 4. With the movement, the exhaust port 10 and the scavenging port 11 each come to open in the order named, to discharge the exhaust gas through the exhaust port 10 to the muffler 9 and introduce fresh gas (air-fuel mixture) through the scavenging port 11 into the combustion chamber 4, thereby implementing gas exchange. This process is called a scavenging stroke.

Particularly, in the present embodiment, a connection position between the piston 3 and the connecting rod 2 (center position of a piston pin) C is offset by D to the same side as a position of the connection center P of the connecting rod 2 to the crankshaft 1 with the exhaust port 10 becoming closed by the piston 3 moving from BDC to TDC, with respect to a straight line A1 which passes the rotation center R of the crankshaft 1 and which is parallel to the reciprocating directions of the piston 3.

When the connection position C between the piston 3 and the connecting rod 2 is offset by D as described above, a crank angle θ1 (cf. FIG. 1), which is an angle between a line segment L1 connecting the connection center P of the connecting rod 2 to the crankshaft 1 and the rotation center R of the crankshaft 1 with the exhaust port 10 becoming closed by the piston 3 moving toward TDC, and a line segment L2 connecting a connection center P1 of the connecting rod 2 to the crankshaft 1 with the piston 3 at BDC and the rotation center R of the crankshaft 1, is smaller than a crank angle θ2 (cf. FIG. 2), which is an angle between a line segment L1 connecting the connection center P of the connecting rod 2 to the crankshaft 1 and the rotation center R of the crankshaft 1 with the exhaust port 10 becoming opened by the piston 3 moving toward BDC, and the line segment L2 connecting the connection center P1 of the connecting rod 2 to the crankshaft 1 with the piston 3 at BDC and the rotation center R of the crankshaft 1 (i.e., $\theta 1<\theta 2$).

In the present embodiment, the connection position C between the piston 3 and the connecting rod 2 lies on a center axis A2 of the piston 3 and the exhaust port 10 is located on the opposite side to the side where the connection position C between the piston 3 and the connecting rod 2 is offset, with respect to the straight line A1. Namely, the piston 3 itself is offset by D to the left in the drawings with respect to the straight line A1 and the exhaust port 10 is disposed on the right in the drawings with respect to the straight line A1.

In the present embodiment, as described above, the connection position C between the piston 3 and the connecting rod 2 is offset to the same side as the position of the connection center P of the connecting rod 2 to the crankshaft 1 with the exhaust port 10 becoming closed by the piston 3 moving from BDC to TDC, with respect to the straight line A1 passing the rotation center R of the crankshaft 1 and being parallel to the reciprocating directions of the piston 3, and this configuration makes the crank angle θ1, which is the angle between the line segment L1 connecting the connection center P of the connecting rod 2 to the crankshaft 1 and the rotation center R of the crankshaft 1 with the exhaust port 10 becoming closed by the piston 3 moving toward TDC, and the line segment L2 connecting the connection center P1 of the connecting rod 2 to the crankshaft 1 with the piston 3 at BDC and the rotation center R of the crankshaft 1, smaller than the crank angle θ2, which is the angle between the line segment L1 connecting the connection center P of the connecting rod 2 to the crankshaft 1 and the rotation center R of the crankshaft 1 with the exhaust port 10 becoming opened by the piston 3 moving toward BDC, and the line segment L2 connecting the connection center P1 of the connecting rod 2 to the crankshaft 1 with the piston 3 at BDC and the rotation center R of the crankshaft 1. Therefore, a period of time before closing of the exhaust port 10 during an ascent of the piston 3 from BDC is shorter than a period of time in which the exhaust port 10 opens during a descent of the piston 3. This makes a period of time from the opening of the exhaust port 10 to arrival of the piston 3 at BDC long enough to achieve sufficient introduction of fresh gas and discharge of exhaust gas, thereby implementing efficient gas exchange. It also decreases the period of time after completion of the scavenging stroke and before the closing of the exhaust port 10, which used to be the cause of the blow-by, and therefore achieves effective reduction of the blow-by.

In the present embodiment, the connection position C between the piston 3 and the connecting rod 2 lies on the center axis A2 of the piston 3 and the exhaust port 10 is disposed on the opposite side to the side where the connection position C is offset by D, with respect to the straight line A1; therefore, the cylinder block 5 housing the piston 3 is arranged as shifted to the opposite side to the exhaust port 10 with respect to the crankcase 6 housing the crankshaft 1 and this allows the length of the cooling fins 14 on the exhaust port 10 side in the cylinder block 5 to be increased without change in the overall width of the two-stroke engine 100 (in the horizontal directions in the drawings), which increases the cooling efficiency.

The above specifically described the present invention on the basis of the embodiment thereof, but it should be noted that the present invention is not limited to the above embodiment: for example, the offset amount can be optionally altered. If the offset amount is increased, the difference between the crank angle θ1 and the crank angle θ2 can be increased.

LIST OF REFERENCE SYMBOLS

1 crankshaft; 2 connecting rod; 3 piston; 4 combustion chamber; 10 exhaust port; 11 scavenging port; 100 two-stroke engine; A1 straight line passing the rotation center of the crankshaft and being parallel to reciprocating directions of the piston; A2 center axis; C connection position between the piston and the connecting rod; D offset; P connection center of the connecting rod to the crankshaft; P1 connection center of the connecting rod to the crankshaft with the piston at BDC; R rotation center of the crankshaft; θ1 and θ2 crank angles.

What is claimed is:

1. A two-stroke engine comprising a scavenging port for introduction of a working gas containing fuel, into a combustion chamber, and an exhaust port for discharge of gas in the combustion chamber therefrom, in which a piston connected to a crankshaft through a connecting rod reciprocates in the combustion chamber with rotary drive of the crankshaft, to control opening and closing of the scavenging port and the exhaust port, in which as the piston moves from a top dead center to a bottom dead center, the exhaust port and the scavenging port open in the order named, and in which as the piston moves from the bottom dead center to the top dead center, the scavenging port and the exhaust port close in the order named, wherein a connection position between the piston and the connecting rod is offset to the same side as a position of a connection center of the connecting rod to the crankshaft with the exhaust port becoming closed by the piston moving from the bottom dead center to the top dead center, with respect to a straight line passing a rotation center of the crankshaft and being parallel to reciprocating directions of the piston, and wherein the crankshaft has a first position in which the exhaust port is closed by the piston while moving toward top dead center, and a second position before the exhaust port is opened by the piston while moving toward bottom dead center, wherein the piston is in an identical position while the crankshaft is in the first position and the second position, wherein a first crank angle is formed between:

a first line segment that connects the connection center of the connecting rod to the crankshaft and the rotation center of the crankshaft when the crankshaft is in the first position, and a second line segment that connects the connection center of the connecting rod to the crankshaft with the piston at bottom dead center and the rotation center of the crankshaft, wherein a second crank angle is formed between:

a third line segment connecting the connection center of the connecting rod to the crankshaft and the rotation center of the crankshaft when the crankshaft is in the second position, and the second line segment, and wherein the first crank angle is smaller than the second crank angle.

2. The two-stroke engine according to claim 1, wherein the connection position between the piston and the connecting rod lies on a center axis of the piston, and wherein the exhaust port is disposed on the opposite side to the side where the connection position is offset, with respect to the straight line.

* * * * *